US009518577B2

(12) United States Patent
van Boeyen et al.

(10) Patent No.: US 9,518,577 B2
(45) Date of Patent: Dec. 13, 2016

(54) APPARATUS FOR PUMPING A FLUID

(75) Inventors: Roger W. van Boeyen, Bryan, TX (US); Jonathan A. Reeh, College Station, TX (US); Mehmet Kesmez, College Station, TX (US); Eric A. Heselmeyer, College Station, TX (US); Jeffrey S. Parkey, Bryan, TX (US)

(73) Assignee: LYNNTECH, INC., College Station, TX (US)

( * ) Notice: Subject to any disclaimer, the term of this patent is extended or adjusted under 35 U.S.C. 154(b) by 772 days.

(21) Appl. No.: 12/490,759

(22) Filed: Jun. 24, 2009

(65) Prior Publication Data

US 2009/0324431 A1 Dec. 31, 2009

Related U.S. Application Data

(60) Provisional application No. 61/076,594, filed on Jun. 27, 2008.

(51) Int. Cl.
*F04B 45/033* (2006.01)
*F04B 45/02* (2006.01)
(Continued)

(52) U.S. Cl.
CPC ..... *F04B 45/02* (2013.01); *F04B 19/24* (2013.01); *F04B 43/10* (2013.01); *F04B 43/107* (2013.01);
(Continued)

(58) Field of Classification Search
CPC ..... F04B 19/24; F04B 45/02; F04B 45/024; F04B 45/0336; F04B 2203/09; F04B 2203/10; F04B 35/008; F04B 43/06; F04B 43/10; F04B 45/033; F04B 45/053; F04B 45/061; F04B 45/073; F04B 47/04; F04B 47/08; F04B 47/145; F04B 9/08; F04B 43/107
(Continued)

(56) References Cited

U.S. PATENT DOCUMENTS 862,867 A * 8/1907 Eggleston ..... F04B 47/04 138/30
2,578,265 A * 12/1951 Saalfrank ..... F04B 43/009 417/458
(Continued)

FOREIGN PATENT DOCUMENTS

DE 2617026 A1 * 10/1977 ..... F03G 6/00

OTHER PUBLICATIONS

DE 2617026 English Translation.*
(Continued)

*Primary Examiner* — Dominick L Plakkoottam
(74) *Attorney, Agent, or Firm* — Edwin S. Flores; Chalker Flores, LLP

(57) ABSTRACT

An electrochemically actuated pump and an electrochemical actuator for use with a pump. The pump includes one of various stroke volume multiplier configurations with the pressure of a pumping fluid assisting actuation of a driving fluid bellows. The electrochemical actuator has at least one electrode fluidically coupled to the driving fluid chamber of the first pump housing and at least one electrode fluidically coupled to the driving fluid chamber of the second pump housing. Accordingly, the electrochemical actuator selectively pressurizes hydrogen gas within a driving fluid chamber. The actuator may include a membrane electrode assembly including an ion exchange membrane with first and second catalyzed electrodes in contact with opposing sides of the membrane, and first and second hydrogen gas chambers in fluid communication with the first and second electrodes, respectively. A controller may reverse the polarity of a voltage source electrically coupled to the current collectors.

6 Claims, 14 Drawing Sheets

(51) Int. Cl.

| | |
|---|---|
| ***F04B 43/107*** | (2006.01) |
| ***F04B 43/10*** | (2006.01) |
| ***F04B 45/053*** | (2006.01) |
| ***F04B 19/24*** | (2006.01) |
| *F04B 43/113* | (2006.01) |

(52) U.S. Cl.
CPC ..... *F04B 45/024* (2013.01); *F04B 45/0336* (2013.01); *F04B 45/053* (2013.01); *F04B 43/1133* (2013.01)

(58) Field of Classification Search
USPC ..... 417/399, 401, 402, 385, 389, 472, 473; 92/37, 39
See application file for complete search history.

(56) References Cited

U.S. PATENT DOCUMENTS 2,613,607 A * 10/1952 Sheen ..... F04B 5/00 417/383
2,613,610 A * 10/1952 Saalfrank ..... F04B 43/08 417/313
2,735,369 A * 2/1956 Turvey ..... F04B 43/009 417/383
2,960,038 A 11/1960 Lupfer et al.
3,524,714 A 8/1970 Grove et al.
4,522,698 A 6/1985 Maget
4,886,514 A 12/1989 Maget
5,141,412 A * 8/1992 Meinz ..... F04B 43/086 417/473
5,149,413 A 9/1992 Maget
5,224,841 A 7/1993 Thompson et al.
5,480,292 A * 1/1996 Chevallier ..... F04B 43/1136 417/393
5,542,918 A 8/1996 Atkinson
5,558,506 A 9/1996 Simmons et al.
6,059,546 A * 5/2000 Brenan ..... F03G 7/065 417/375
6,167,721 B1 1/2001 Tsenter
6,224,343 B1 * 5/2001 Newcomer ..... F04B 43/084 417/118
6,345,963 B1 2/2002 Thomin et al.
7,168,928 B1 1/2007 West et al.
2005/0084395 A1 4/2005 Kang
2005/0121974 A1 * 6/2005 Buschmann ..... B60T 8/409 303/122.09
2010/0108534 A1 5/2010 Carlstrom, Jr. et al.
2010/0108536 A1 5/2010 Carlstrom, Jr. et al.
2010/0112381 A1 5/2010 Carlstrom, Jr. et al.

OTHER PUBLICATIONS

Tsenter and Velichkovsky "Electrochemical Pump for Liquid Cooling Application", XVII. The seventeenth Annual Battery Conference on Applications and Advances, 0-7803-7132-1/02 IEEE, 2002, pp. 297-301.

* cited by examiner

Dual diaphragm/bellow pump

Reciprocating dual diaphragm/bellow pump

Reciprocating dual diaphragm/bellow pump

B

APPARATUS FOR PUMPING A FLUID

CROSS-REFERENCE TO RELATED APPLICATIONS

This application claims priority of the provisional patent application 61/076,594 filed on Jun. 27, 2008.

STATEMENT REGARDING FEDERALLY SPONSORED RESEARCH OR DEVELOPMENT

This invention was made with government support under contract number N00164-06-C-6051 awarded by the Department of Defense (Navy) and contract number NNM08AA06C awarded by the National Aeronautics and Space Administration (NASA). The government has certain rights in this invention.

BACKGROUND OF THE INVENTION

1. Field of the Invention

The present inventions relate to electrochemical cells and their use as actuators, as well as fluid-driven pump assemblies compatible with electrochemical, electrical and mechanical actuators.

2. Background of the Related Art

A pump is a device that moves liquids or gases from lower pressure to higher pressure, and overcomes this difference in pressure by adding energy to the system. However, there are numerous types of pumps, each with their own advantages and disadvantages. Pumps may operate on different forms of energy, produce different flow rates and pressures, have different efficiencies, and so on. Pumps also contain numerous moving parts that cause inefficiencies, wear and occasional failures. Accordingly, it is extremely important to select an appropriate pump for a specific application. Despite the existing pumps available today, there is always a need for improved pumps that will more specifically meet the needs of existing or future applications.

BRIEF SUMMARY OF THE INVENTION

One embodiment of the present invention provides a pump head operable with a driving fluid. The pump head comprises a pump housing including a moveable element that separates a driving fluid chamber from a pumping fluid chamber, an inlet check valve disposed to allow unidirectional fluid communication of a pumping fluid into the pumping fluid chamber, and an outlet check valve disposed to allow unidirectional fluid communication of the pumping fluid out of the pumping fluid chamber. The pump head also comprises first and second control valves in fluid communication with the driving fluid chamber and selectively operable to establish the driving fluid chamber in fluid communication with a driving fluid source or vacuum.

Another embodiment of the invention provides an electrochemically actuated pump. The electrochemically actuated pump comprises first and second pump housings, wherein each pump housing includes a moveable element that separates a driving fluid chamber from a pumping fluid chamber, an inlet check valve disposed to allow unidirectional fluid communication of a pumping fluid into the pumping fluid chamber, and an outlet check valve disposed to allow unidirectional fluid communication of the pumping fluid out of the pumping fluid chamber. The electrochemically actuated pump also includes an electrochemical actuator having at least one electrode fluidically coupled to the driving fluid chamber of the first pump housing and at least one electrode fluidically coupled to the driving fluid chamber of the second pump housing.

Yet another embodiment of the invention provides an electrochemical actuator. The electrochemical actuator comprises a membrane electrode assembly including an ion exchange membrane with first and second catalyzed electrodes in contact with opposing sides of the membrane, first and second current collectors in contact with the respective first and second catalyzed electrodes, a first hydrogen gas chamber in fluid communication with the first electrode, and a second hydrogen gas chamber in fluid communication with the second electrode. The electrochemical actuator also includes a controller for controllably reversing the polarity of a voltage source electrically coupled to the current collectors, wherein a first polarity causes the first electrode to function as the anode and the second electrode to function as the cathode, such that the first polarity simultaneously decreases the hydrogen gas pressure in the first hydrogen gas chamber and increases the hydrogen gas pressure in the second hydrogen gas chamber. Furthermore, a second polarity causes the first electrode to function as the cathode and the second electrode to function as the anode, such that the second polarity simultaneously increases the hydrogen gas pressure in the first hydrogen gas chamber and decreases the hydrogen gas pressure in the second hydrogen gas chamber.

DETAILED DESCRIPTION OF THE INVENTION

Figure 1A:
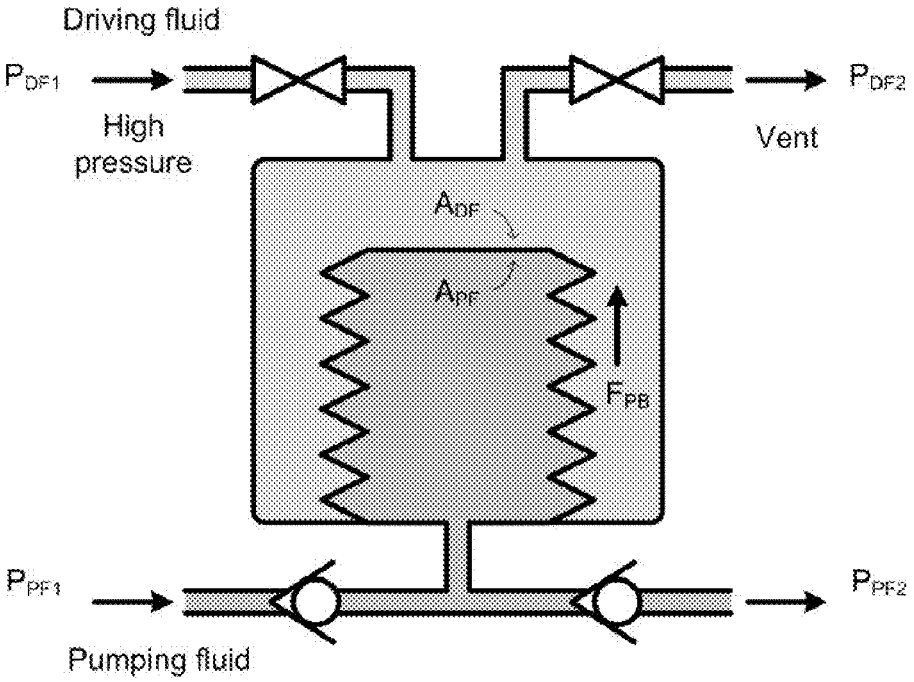
FIG. 1A (PRIOR ART)
FIGS. 1A and 1B are schematic diagrams of prior art (U.S. Pat. No. 3,524,714) fluid-driven pump assemblies including a bellows separating a driving fluid from a pumping fluid.

One embodiment of the present invention provides a pump head operable with a driving fluid. The pump head comprises a pump housing including a moveable element that separates a driving fluid chamber from a pumping fluid chamber, an inlet check valve disposed to allow unidirectional fluid communication of a pumping fluid into the pumping fluid chamber, and an outlet check valve disposed to allow unidirectional fluid communication of the pumping fluid out of the pumping fluid chamber. The pump head also comprises first and second control valves in fluid communication with the driving fluid chamber and selectively operable to establish the driving fluid chamber in fluid communication with a driving fluid source, vent, or vacuum. The driving fluid source may be a pressurized liquid or gas from a mechanical pump or pressurized cylinder.

In another embodiment, the moveable element is a rigid plate, such as a metal plate. Accordingly, the driving fluid chamber may include a first expandable bellows secured and sealed between a first side of the rigid plate and a first side of the pump housing. Similarly, the pumping fluid chamber may include a second expandable bellows secured and sealed between a second side of the rigid plate and a second side of the pump housing. The pump housing itself may be open to the atmosphere or the pumping fluid around the outer surfaces of the first and second expandable bellows. Preferably, the first and second expandable bellows define an axial direction of expansion and retraction.

In yet another embodiment, the moveable element is a rigid plate that can be used as a stroke volume multiplier. The term "stroke volume multiplier", as used herein, means a device that enables a given volume of a first fluid (i.e., a driving fluid) to displace a larger volume of a second fluid (i.e., a pumping fluid). Accordingly, the first and second expandable bellows each have a cross-sectional area in a plane perpendicular to the axial direction of expansion and retraction, wherein the cross-sectional area inside the first expandable bellows is less than the cross-sectional area inside the second expandable bellows. The ratio of driving fluid to pumping fluid can be altered by changing the relative cross-sectional area of the driving fluid chamber and the pumping fluid chamber. The atmospheric pressure acting on the larger cross-sectional area of the pumping fluid bellows assists in pressurizing and displacing the pumping fluid from the pumping fluid bellows. In this manner, the pumping fluid pressure required to displace the pumping fluid can be reduced. The atmospheric pressure also acts to impede drawing of the pumping fluid into the pump fluid chamber, thereby requiring a reduced vent/vacuum pressure to fully expand the pumping fluid bellows.

The combined spring force of the two bellows can act either in unison or opposition to the force applied by the driving fluid. When acting in unison with the force applied by the driving fluid, the spring force of the bellows assists in pressurizing and displacing the pumping fluid from the pumping fluid chamber, thereby reducing the required driving fluid pressure. When acting in unison, the spring force of the bellows also impedes drawing of the pumping fluid into the pumping fluid chamber, thereby requiring a reduced vent/vacuum pressure.

When acting in opposition to the force applied by the driving fluid, the spring force of the bellows impedes the pressurization and displacement of the pumping fluid and assists the drawing of the pumping fluid into the pumping fluid chamber, thereby increasing the required driving fluid pressure and allowing a higher vent/vacuum pressure to be used.

It should be recognized that the expandable bellows may be suitably substituted, in many embodiments, with another form of diaphragm, a piston, or some combination of these devices.

In a further embodiment, a spring is disposed concentric to the first expandable bellows, which contains driving fluid, between the first side of the rigid plate and a first side of the pump housing, wherein the spring biases the first expandable bellows to expand in the axial direction. In this configuration, the expansion force of the spring assists the expansion of the first expandable bellows, thereby reducing the driving fluid pressure necessary to expand the bellows. However, using a spring will also necessitate a reduced vent/vacuum to later counteract the spring force when drawing the pump fluid into the pumping fluid bellows.

The spring may also be configured within the pump to act in opposition to the force applied by the driving fluid, thereby assisting in drawing the pumping fluid into the pumping fluid chamber, thereby allowing a higher driving fluid vent/vacuum pressure. However, a spring configured in this manner will impede pressurizing and displacing of the pumping fluid from the pumping fluid chamber, thereby requiring a higher driving fluid pressure to fully contract the pumping fluid bellows.

In a still further embodiment, the second expandable bellows is secured concentrically about the first expandable bellows between the first side of the rigid plate and the first side of the pump housing. The difference in cross-sectional area still serves to multiple the stroke volume of the driving fluid, but the second expandable bellows is now positioned to assist the expansion of the first expandable bellows. Such a concentric arrangement of the first and second bellows may also be combined with a concentric spring, as discussed above.

Another embodiment of the invention provides an electrochemically actuated pump. The electrochemically actuated pump comprises first and second pump housings, wherein each pump housing includes a moveable element that separates a driving fluid chamber from a pumping fluid chamber, an inlet check valve disposed to allow unidirectional fluid communication of a pumping fluid into the pumping fluid chamber, and an outlet check valve disposed to allow unidirectional fluid communication of the pumping fluid out of the pumping fluid chamber. The electrochemically actuated pump also includes an electrochemical actuator having at least one electrode fluidically coupled to the driving fluid chamber of the first pump housing and at least one electrode fluidically coupled to the driving fluid chamber of the second pump housing.

When the electrochemical actuator is not a stack, i.e., either a single cell or multiple cells physically arranged in parallel on the same side of a membrane, the at least one electrode that is fluidically coupled to the driving fluid chamber of the first pump housing preferably faces directly into the driving fluid chamber of the first pump housing and the at least one electrode that is fluidically coupled to the driving fluid chamber of the second pump housing preferably faces directly into the driving fluid chamber of the second pump housing. This arrangement reduces the "dead volume" of gases within tubes or channels.

In a preferred embodiment, the electrochemical actuator is an electrochemical hydrogen pump. Optionally, the electrochemical actuator is an electrochemical hydrogen pump stack. Regardless of the exact nature of the electrochemical actuator, it may be used in direct fluid communication with any of the pump heads discussed above. Most preferably, the electrochemical actuator is used in conjunction with two pump heads in order to take full advantage of the electrochemical actuator's ability to simultaneously produce high pressure at one electrode and a vacuum at the other electrode. Typically, the two pump heads will operate out of phase with each other, so that one pump head is receiving high pressure while the other pump is receiving vacuum pressure.

In a still further embodiment, the electrochemical actuator further comprises a controller for controllably reversing the polarity of a voltage source electrically coupled between the opposing electrodes. A first polarity simultaneously increases the hydrogen gas pressure in the driving fluid chamber of the first pump housing and decreases the hydrogen gas pressure in the driving fluid chamber of the second pump housing, and a second polarity simultaneously decreases the hydrogen gas pressure in the driving fluid chamber of the first pump housing and increases the hydrogen gas pressure in the driving fluid chamber of the second pump housing. Switching between the two polarities causes the driving fluid to move back and forth between the driving fluid chambers of the two pump housings. Each pump housing thus goes through an inlet stroke as the gas pressure in the driving fluid chamber decreases and outlet stroke as the gas pressure in the driving fluid chamber increases. The check valves associated with the pumping fluid chamber operate to control the direction of pumping fluid flow.

In a further embodiment, an electrolyzer is disposed to produce hydrogen gas into the first or second driving fluid chamber. The electrolyzer preferably produces hydrogen gas from water stored within the electrolyzer membrane. Optionally, a controller operates the electrolyzer to replace hydrogen gas that leaks out of the first and second driving fluid chambers, optionally in accordance with a gas pressure sensor or by measuring the stroke length. In an optional embodiment, a metal/air electrochemical cell or battery may be disposed to consume oxygen gas produced as a byproduct of producing hydrogen gas with the electrolyzer.

In a further embodiment, a metal hydride alloy material is disposed to store hydrogen gas within the electrochemical actuator. The hydrogen can be reversibly moved between the metal hydride and the first or second driving fluid chamber through either gas phase or electrochemical means.

Yet another embodiment of the invention provides an electrochemical actuator. The electrochemical actuator comprises a membrane electrode assembly (MEA) including an ion exchange membrane with first and second catalyzed electrodes in contact with opposing sides of the membrane, first and second current collectors in contact with the respective first and second catalyzed electrodes, a first hydrogen gas chamber in fluid communication with the first electrode, and a second hydrogen gas chamber in fluid communication with the second electrode. The electrochemical actuator also includes a controller for controllably reversing the polarity of a voltage source electrically coupled to the first and second current collectors, wherein a first polarity causes the first electrode to function as the anode and the second electrode to function as the cathode, such that the first polarity simultaneously decreases the hydrogen gas pressure in the first hydrogen gas chamber and increases the hydrogen gas pressure in the second hydrogen gas chamber, and wherein a second polarity causes the first electrode to function as the cathode and the second electrode to function as the anode, such that the second polarity simultaneously decreases the hydrogen gas pressure in the first hydrogen gas chamber and increases the hydrogen gas pressure in the second hydrogen gas chamber. In one embodiment, the electrochemical actuator includes a plurality of the membrane electrode assemblies connected electronically in series, optionally in a stack.

A stroke volume multiplier, described briefly above, may be used to yield a large reduction in hydrogen gas pressure, and thereby hydrogen flow rate and pump power draw. This is a technique that uses the atmospheric pressure to assist in pressurizing and driving the pumping fluid from pumping fluid chamber. This is implemented into the fluid pump by using a small diameter driving fluid bellows to actuate a larger diameter fluid pump bellows. In this way, the external atmospheric pressure can act on the larger cross-sectional area of the fluid pump bellows, resulting in a lower required hydrogen gas driving pressure. This is advantageous due to the significant reduction in the required hydrogen gas pressure, flow rate and pump power consumption. This technique also necessitates a lower hydrogen pressure when contracting the driving bellows to draw the pumping fluid into the pumping fluid bellows. This technique is well suited to being employed in combination with an electrochemical hydrogen pump since the stroke volume multiplier can take advantage of both the high pressure and vacuum pressure generated by the electrochemical hydrogen pump.

The electrochemical hydrogen pump current is given by $$I = \frac{2N_A}{C} N'_{H2} = \frac{2}{C} \frac{P_{H2} F_{VH2}}{kT},$$

where $N'_{H2}$ is the molar flow rate of hydrogen, $F_{VH2}$ is the volumetric flow rate of hydrogen, $P_{H2}$ is the hydrogen gas pressure, T is the hydrogen gas temperature, $N_A$ is Avogadro's number, C is a coulomb, and k is Boltzmann's constant.

Without the use of a stroke volume multiplier, the volumetric driving fluid (hydrogen) flow rate will equal the volumetric pumping fluid flow rate, and the hydrogen gas pressure will equal the pumping fluid pressure. The stroke volume multiplier is effective in reducing the in pump current and power draw when the output pumping fluid pressure is comparable to the atmospheric pressure. If this is the case, then with the stroke volume multiplier, the majority of the work performed by the electrochemical hydrogen pump is in displacing the pumping fluid. Without the stroke volume multiplier, a significant proportion of the work performed by the electrochemical hydrogen pump is in simply equalizing the hydrogen pressure to atmospheric pressure within the driving fluid bellows.

In addition to reducing the power consumption of the pump, the stroke volume multiplier also dramatically improves lifetime and reliability of the pump over conventional pumps by reducing the stroke frequency. Conventional reciprocating displacement pumps typically operate at high RPMs which significantly adds to kinetic loses, wear and friction. The high internal pressures that can be generated by the electrochemical hydrogen pump enable the driving fluid bellows to actuate the larger area pumping fluid bellows. The long stroke and large area of the pumping fluid bellows result in large volume displacement per stroke and a correspondingly low stroke frequency.

Figure 1B:
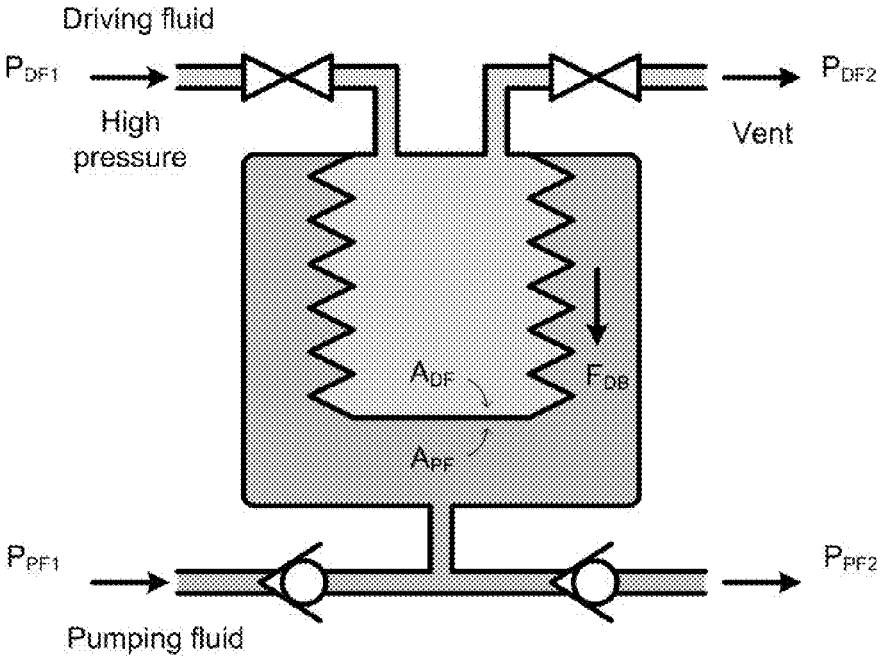
FIG. 1B (PRIOR ART)

FIGS. 1A and 1B are schematic diagrams of prior art (U.S. Pat. No. 3,524,714) fluid-driven pump assemblies including a bellows separating a driving fluid from a pumping fluid. The driving fluid exerts a downward force on the bellows over an area labeled $A_{DF}$ and the pumping fluid exerts an upward force on the bellows over an area labeled $A_{PF}$. The distance between the maximum compression and maximum extension of the bellows may be referred to as d. Accordingly, the following equations characterize the operation of the pump:

$$\text{Driving fluid volume displaced} = V_{DF} = d \times A_{DF}$$

$$\text{Pumping fluid volume displaced} = V_{PF} = d \times A_{PF}$$

$$\text{For the single bellows pump, } V_{DF} = V_{PF}$$

It is assumed that there is no 'dead volume' within the pump. With respect to FIG. 1A, this means that when the bellows is fully extended there is zero driving fluid volume in the pump and when the bellows is fully compressed there is zero pumping fluid volume in the pump. If we refer to the force exerted by the pumping bellows at its maximum compression as $F_{PB\text{-}comp}$ and the force exerted by the pumping bellows at its maximum expansion as $F_{PB\text{-}exp}$, then the following equations further characterize the operation of the pump:

$$\begin{aligned}\text{Actuation Force at the limit of the pumping stroke} &= P_{DF1} \times A_{PF} \\ &= P_{PF2} \times A_{PF} + F_{PB-comp}\end{aligned}$$

$$\begin{aligned}\text{Actuation Pressure} &= P_{DF1} \\ &= \frac{P_{PF2} \times A_{PF} + F_{PB-comp}}{A_{DF}} \\ &= P_{PF2} + \frac{F_{PB-comp}}{A_{DF}}\end{aligned}$$

$$\begin{aligned}\text{Retraction Force} &= P_{DF2} \times A_{DF} \\ &= P_{PF1} \times A_{PF} + F_{PB-exp}\end{aligned}$$

$$\begin{aligned}\text{Retraction Pressure} &= P_{DF2} \\ &= \frac{P_{PF1} \times A_{PF} + F_{PB-exp}}{A_{DF}} \\ &= P_{PF1} + \frac{F_{PB-comp}}{A_{DF}}\end{aligned}$$

$$\begin{aligned}\text{Moles of driving gas/pumping volume displaced} &= \frac{N}{V_{PF}} \propto \frac{P_{DF1} \times V_{DF}}{V_{PF}} \\ &= P_{PF2} + \frac{F_{PB-comp}}{A_{PF}}\end{aligned}$$

Referring to FIG. 1B, the force exerted by the driving bellows at its maximum expansion is labeled $F_{DB\text{-}exp}$ and the force exerted by the driving bellows at its maximum compression is labeled $F_{DB\text{-}comp}$. Therefore, for the pump of FIG. 1B, the following equations characterize the operation of the pump:

$$\text{Actuation Force at the limit of the pumping stroke} = P_{DF1} \times A_{DF} + F_{DB-exp} = P_{PF2} \times A_{PF}$$

$$\text{Actuation Pressure} = P_{DF1} = \frac{P_{PF2} \times A_{PF} - F_{DB-exp}}{A_{DF}} = P_{PF2} - \frac{F_{DB-exp}}{A_{DF}}$$

$$\text{Retraction Force} = P_{DF2} \times A_{DF} + F_{DB-comp} = P_{PF1} \times A_{PF}$$

$$\text{Retraction Pressure} = P_{DF2} = \frac{P_{PF1} \times A_{PF} + F_{PB-comp}}{A_{DF}} = P_{PF1} - \frac{F_{DB-comp}}{A_{DF}}$$

$$\text{Driving fluid volume displaced} = V_{DF} = d \times A_{DF} = d \times A_{PF}$$

$$\text{Pumping fluid volume displaced} = V_{PF} = d \times A_{PF} = d \times A_{DF}$$

$$\text{Moles of driving gas/pumping volume displaced} = \frac{N}{V_{PF}} \propto \frac{P_{DF1} \times V_{DF}}{V_{PF}} = P_{PF2} - \frac{F_{DB-exp}}{A_{PF}}$$

Figure 2A:
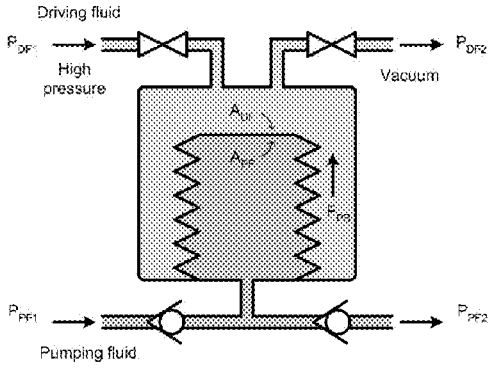
FIGS. 2A and 2B are schematic diagrams of pump assemblies including a bellows operated by a driving fluid alternating between high-pressure and vacuum-pressure.
Figure 2B:
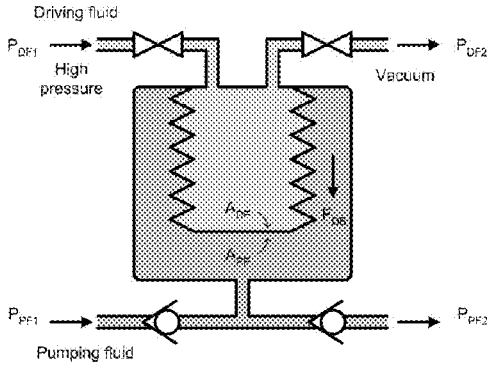

FIGS. 2A and 2B are schematic diagrams of pump assemblies including a bellows operated by a driving fluid alternating between high-pressure and vacuum-pressure. Although the driving fluid is typically vented to atmosphere, i.e. the outlet pressure $P_{DF2}$ is equal to atmospheric pressure, if $P_{DF2}$ is reduced then $P_{DF1}$ can also be reduced while still retaining the same amount of pumping fluid displacement. The effect of this is to reduce the maximum expansion of the bellows and increase the maximum compression of the bellows. Reducing $P_{DF1}$ reduces the number of moles of driving gas/pumping volume displaced:

$$\frac{N}{V_{PF}} \propto \frac{P_{DF1} \times V_{DF}}{V_{PF}} = P_{PF2} + \frac{F_{PB-comp}}{A_{PF}} \quad \text{(FIG. 2A)}$$

$$\frac{N}{V_{PF}} \propto \frac{P_{DF1} \times V_{DF}}{V_{PF}} = P_{PF2} - \frac{F_{DB-exp}}{A_{PF}} \quad \text{(FIG. 2B)}$$

Typically, in a bellows pump, this is of no advantage since power savings from the reduced driving gas flow rate and pressure are more than offset by the increase in power requirements to generate the vacuum pressure. However, an electrochemical actuator can simultaneous generate both a driving pressure and vacuum pressure at no additional energy cost.

Figure 3:
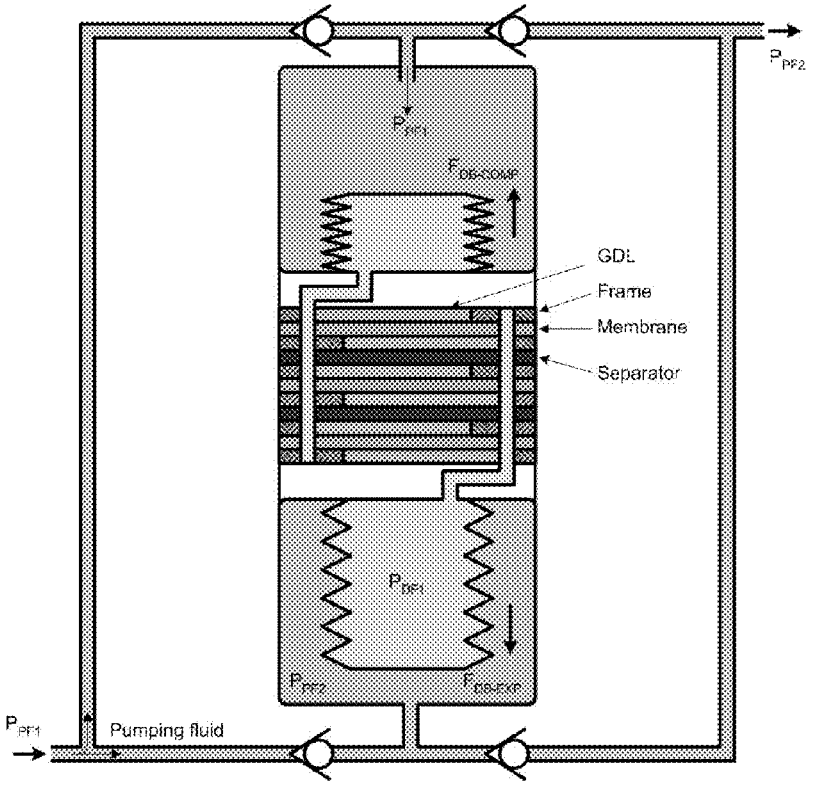
FIG. 3 is a schematic diagram of two pump assemblies according to FIG. 2B, wherein a first pump assembly has a driving fluid chamber fluidically coupled to the anode manifold of an electrochemical hydrogen pump stack and a second pump assembly has a driving fluid chamber fluidically coupled to the cathode manifold of the electrochemical hydrogen pump stack.

FIG. 3 is a schematic diagram of two pump assemblies according to FIG. 2B, wherein a first pump assembly has a driving fluid chamber fluidically coupled to the anode manifold of an electrochemical hydrogen pump stack and a second pump assembly has a driving fluid chamber fluidically coupled to the cathode manifold of the electrochemical hydrogen pump stack.

It should be recognized from FIG. 3 that the electrochemical hydrogen pump serves as the source of driving fluid and eliminates the need for a separate control valve. Rather, the amount of electronic current supplied to the electrochemical hydrogen pump controls the amount of hydrogen gas that will be introduced into the driving fluid chamber. The control valves shown in the schematic diagrams of FIGS. 1A-2B and FIGS. 4A-13 can be eliminated when an electrochemical hydrogen pump is used. Furthermore, there no need for separate high pressure and vent/vacuum ports connecting to the driving fluid chamber, since the reversal of polarity applied to the electrochemical hydrogen pump introduces and withdraws hydrogen gas through the same port.

Figure 4A:
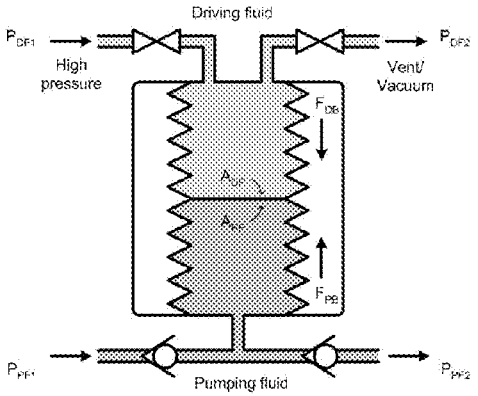
FIG. 4A (PRIOR ART)
FIGS. 4A and 4B are schematic diagrams of prior art (U.S. Pat. No. 862,867) fluid-driven pump assemblies including a driving fluid bellows coupled to a separate pumping fluid bellows.
Figure 4B:
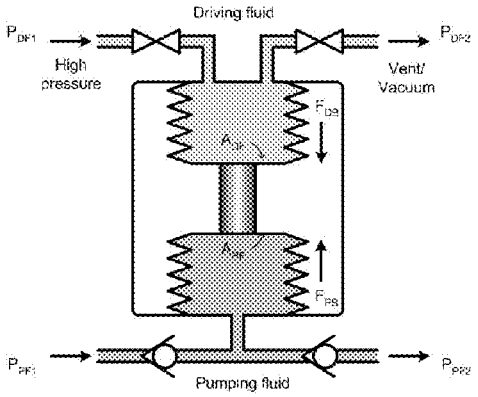
FIG.4B (PRIOR ART)

FIGS. 4A and 4B are schematic diagrams of prior art (U.S. Pat. No. 862,867) fluid-driven pump assemblies including a driving fluid bellows coupled to a separate pumping fluid bellows.

$$\text{Actuation Force at the limit of the pumping stroke} = P_{DF1} \times A_{DF} + F_{DB-exp} = P_{PF2} \times A_{PF} + F_{PB-comp}$$

$$\text{Actuation Pressure} = P_{DF1} = \frac{P_{PF2} \times A_{PF} + F_{PB-comp} - F_{DB-exp}}{A_{DF}}$$

$$\text{Retraction Force} = P_{DF2} \times A_{DF} + F_{DB-comp} = P_{PF1} \times A_{PF} + F_{PB-exp}$$

$$\text{Retraction Pressure} = P_{DF2} = \frac{P_{PF1} \times A_{PF} + F_{PB-exp} - F_{DB-comp}}{A_{DF}}$$

$$\text{Moles of driving gas/pumping volume displaced} = \frac{\Delta N}{V_{PF}} \propto \frac{P_{DF1} \times V_{DF}}{V_{PF}} = P_{DF2} + \frac{F_{PB-comp} - F_{DB-exp}}{A_{PF}}$$

The opposing forces of the bellows counter-act each other. If the two bellows are identical the combined spring rate will be double the individual spring rate and the resultant bellows force will be double that experienced in FIG. 1A and FIG. 1B. To achieve the same flow rate will require a larger driving pressure, and hence a larger power consumption.

Figure 5A:
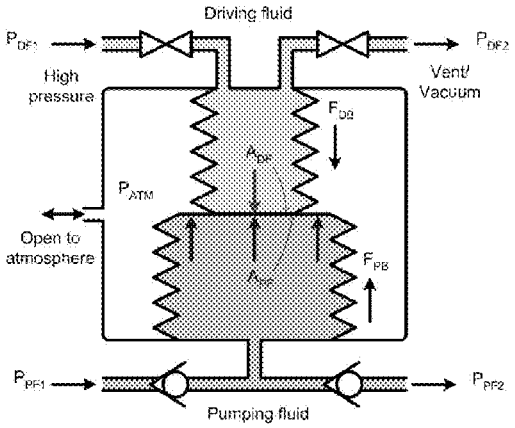
FIG. 5A is a schematic diagram of a pump assembly including a stroke volume multiplier with the atmospheric pressure assisting in pressurizing and displacing the pumping fluid from the pumping fluid chamber.

FIG. 5A is a schematic diagram of a pump assembly including a stroke volume multiplier.

$$\text{Actuation Force at the limit of the pumping stroke} = P_{DF1} \times A_{DF} + P_{Atm}(A_{PF} - A_{DF}) + F_{DB-exp} = P_{PF2} \times A_{PF} + F_{PB-comp}$$

$$\text{Actuation Pressure} = P_{DF1} = \frac{P_{PF2} \times A_{PF} - P_{Atm}(A_{PF} - A_{DF}) + F_{PB-comp} - F_{DB-exp}}{A_{DF}}$$

-continued $$\text{Retraction Force} = P_{DF2} \times A_{DF} + P_{Atm}(A_{PF} - A_{DF}) + F_{DB-comp} = P_{PF1} \times A_{PF} + F_{PB-exp}$$

$$\text{Retraction Pressure} = P_{DF2} = \frac{P_{PF1} \times A_{PF} - P_{Atm}(A_{PF} - A_{DF}) + F_{PB-exp} - F_{DB-comp}}{A_{DF}}$$

Driving fluid volume displaced, $V_{DF} = d \times A_{DF}$

Pumping fluid volume displaced, $V_{PF} = d \times A_{PF}$ $$\text{Moles of driving gas/pumping volume displaced} = \frac{\Delta N}{V_{PF}} \propto \frac{P_{DF1} \times V_{DF}}{V_{PF}} = \frac{P_{DF1} \times A_{DF}}{A_{PF}} = P_{PF2} - P_{Atm} + \frac{P_{Atm} A_{DF}}{A_{PF}} + F_{PB-comp} - \frac{F_{DB-exp}}{A_{PF}}$$

The stroke volume multiplier results in an increase in the required driving pressure and a reduction in the number of moles of driving gas required per stroke. Typically, in a bellows pump, this is of no advantage since the power saving from the reduced driving gas flow rate is more than offset by the increase in power requirements for the higher driving fluid pressure. Compressor efficiency is typically more sensitive to pressure than flow rate. For this reason bellows pumps are typically designed to operate at low driving gas pressure and high volumetric flow rate.

Pump loses for the electrochemical actuator, on the other hand, are determined primarily by the mass flow rate. The reduction in power loses is approximately proportional to the square of the reduction in the number of moles of driving gas/pumping volume displaced. This allows for bellows pump operation at high driving pressures and low volumetric flow rates without a significant increase in power loses.

Figure 5B:
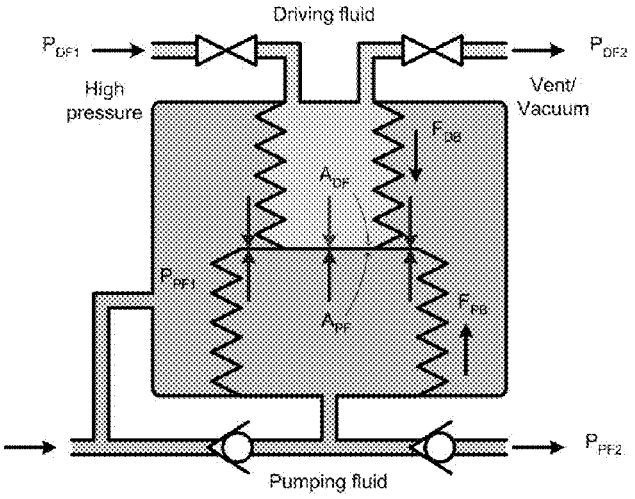
FIG. 5B is a schematic diagram of a pump assembly including a stroke volume multiplier with the pressure of the pumping fluid source assisting in pressurizing and displacing the pumping fluid from the pumping fluid chamber.

FIG. 5B is a schematic diagram of a pump assembly including a stroke volume multiplier with the pressure of the pumping fluid source assisting in pressurizing and displacing the pumping fluid from the pumping fluid chamber.

$$\text{Actuation Force at the limit of the pumping stroke} = P_{DF1} \times A_{DF} + P_{PF1}\left(\frac{A_{PF} -}{A_{DF}}\right) + F_{DB-exp} = P_{PF2} \times A_{PF} + F_{PB-comp}$$

$$\text{Actuation Pressure} = P_{DF1} = \frac{P_{PF2} \times A_{PF} - P_{PF1}\left(\frac{A_{PF} -}{A_{DF}}\right) + F_{PB-comp} - F_{DB-exp}}{A_{DF}}$$

$$\text{Retraction Force} = P_{DF2} \times A_{DF} + P_{PF1}(A_{PF} - A_{DF}) + F_{DB-comp} = P_{PF1} \times A_{PF} + F_{PB-exp}$$

-continued $$\text{Retraction Pressure} = P_{DF2} = \frac{P_{PF1} \times A_{PF} - P_{PF1}\left(\frac{A_{PF} -}{A_{DF}}\right) + F_{PB-exp} - F_{DB-comp}}{A_{DF}}$$

$$\text{Moles of driving gas/pumping volume displaced} = \frac{N}{V_{PF}} \propto \frac{P_{DF1} \times V_{DF}}{V_{PF}} = \frac{P_{DF1} \times A_{DF}}{A_{PF}} = P_{PF2} - P_{PF1} + \frac{P_{PF1} A_{DF}}{A_{PF}} + \frac{F_{PB-comp} - F_{DB-exp}}{A_{PF}} = \Delta P_{PF} + \frac{P_{PF1} A_{DF}}{A_{PF}} + \frac{F_{PB-comp} - F_{DB-exp}}{A_{PF}}$$

In the case where $P_{PF1} > P_{Atm}$, a further reduction in the number of moles of driving gas/pumping volume displaced, and power consumption of the electrochemical actuator, can be gained by porting the inlet pumping pressure to the outside of the pumping bellows.

Figure 5C:
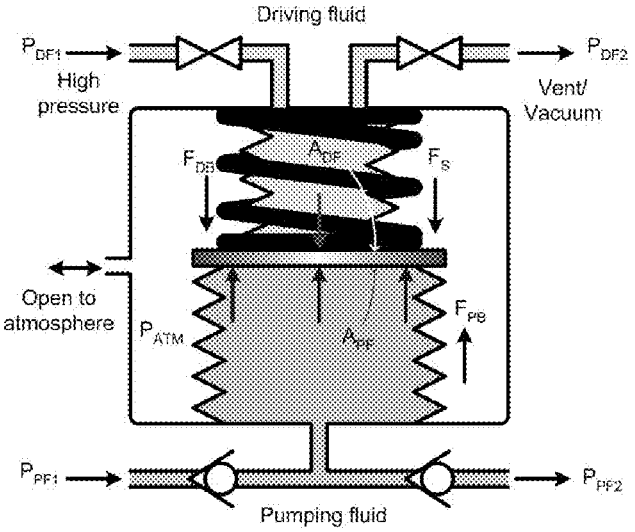
FIG. 5C is a schematic diagram of a pump assembly including a stroke volume multiplier with a spring assisting in pressurizing and displacing the pumping fluid from the pumping fluid chamber.

FIG. 5C is a schematic diagram of a pump assembly including a stroke volume multiplier with a spring assisting in pressurizing and displacing the pumping fluid from the pumping fluid chamber.

$$\text{Actuation Force at the limit of the pumping stroke} = P_{DF1} \times A_{DF} + P_{Atm}\left(\frac{A_{PF} -}{A_{DF}}\right) + F_{DB-exp} + F_S = P_{PF2} \times A_{PF} + F_{PB-comp}$$

$$\text{Actuation Pressure} = P_{DF1} = \frac{P_{PF2} \times A_{PF} - P_{Atm}(A_{PF} - A_{DF}) + F_{PB-comp} - F_{DB-exp} - F_S}{A_{DF}}$$

$$\text{Retraction Force} = P_{DF2} \times A_{DF} + P_{Atm}(A_{PF} - A_{DF}) + F_{DB-comp} + F_S = P_{PF1} \times A_{PF} + F_{PB-exp}$$

$$\text{Retraction Pressure} = P_{DF2} = \frac{P_{PF1} \times A_{PF} - P_{Atm}(A_{PF} - A_{DF}) + F_{PB-exp} - F_{DB-comp} - F_S}{A_{DF}}$$

-continued $$\text{Moles of driving gas/pumping volume displaced} = \frac{N}{V_{PF}} \propto \frac{P_{DF1} \times V_{DF}}{V_{PF}} = \frac{P_{DF1} \times A_{DF}}{A_{PF}} = P_{PF2} - P_{Atm} + \frac{P_{Atm} A_{DF}}{A_{PF}} + F_{PB-comp} - \frac{F_{DB-exp} - F_S}{A_{PF}}$$

The effect of the spring force is to reduce the driving and vacuum pressure required and the number of moles of driving gas displaced. As previously stated, this is of no advantage to a typical bellows pump since power saving from the reduced driving gas flow rate and pressure are more than offset by the increase in power required for the lower vacuum pressure. However, with an electrochemical actuator, the reduction in power is proportional to the square of the reduction in the number of moles of driving gas required per stroke.

Figure 5D:
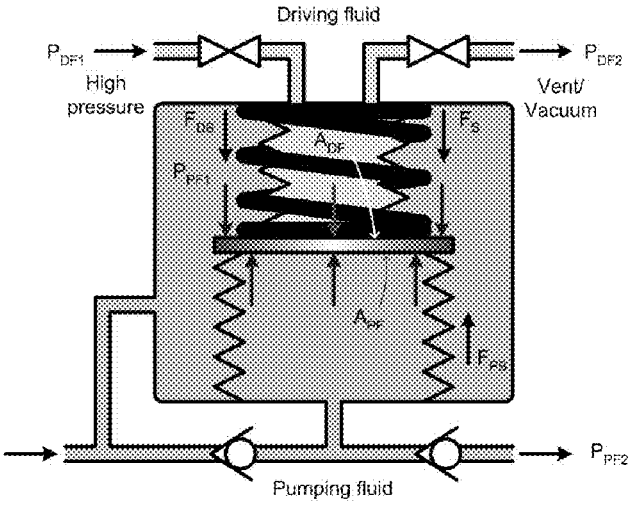
FIG. 5D is a schematic diagram of a pump assembly including a stroke volume multiplier with a spring and the pressure of the pumping fluid source both assisting in pressurizing and displacing the pumping fluid from the pumping fluid chamber.

FIG. 5D is a schematic diagram of a pump assembly including a stroke volume multiplier with a spring and the pressure of the pumping fluid source both assisting in pressurizing and displacing the pumping fluid from the pumping fluid chamber.

$$\text{Actuation Force at the limit of the pumping stroke} = P_{DF1} \times A_{DF} + P_{PF1}\left(\frac{A_{PF}}{A_{DF}} - \right) + F_{DB-exp} + F_S = P_{PF2} \times A_{PF} + F_{PB-comp}$$

$$\text{Actuation Pressure} = P_{DF1} = \frac{P_{PF2} \times A_{PF} - P_{PF1}(A_{PF} - A_{DF}) + F_{PB-comp} - F_{DB-exp} - F_S}{A_{DF}}$$

$$\text{Retraction Force} = P_{DF2} \times A_{DF} + P_{PF1}(A_{PF} - A_{DF}) + F_{DB-comp} + F_S = P_{PF1} \times A_{PF} + F_{PB-exp}$$

$$\text{Retraction Pressure} = P_{DF2} = \frac{P_{PF1} \times A_{PF} - P_{PF1}(A_{PF} - A_{DF}) + F_{PB-exp} - F_{DB-comp} - F_S}{A_{DF}}$$

$$\text{Moles of driving gas/pumping volume displaced} = \frac{N}{V_{PF}} \propto \frac{P_{DF1} \times V_{DF}}{V_{PF}} = \frac{P_{DF1} \times A_{DF}}{A_{PF}} = P_{DF2} - P_{PF1} + \frac{P_{PF1} \times A_{DF}}{A_{PF}} + F_{PB-comp} - \frac{F_{DB-exp} - F_S}{A_{PF}} = \Delta P_{PF} + \frac{P_{PF1} \times A_{DF}}{A_{PF}} + F_{PB-comp} - \frac{F_{DB-exp} - F_S}{A_{PF}}$$

Figure 6:
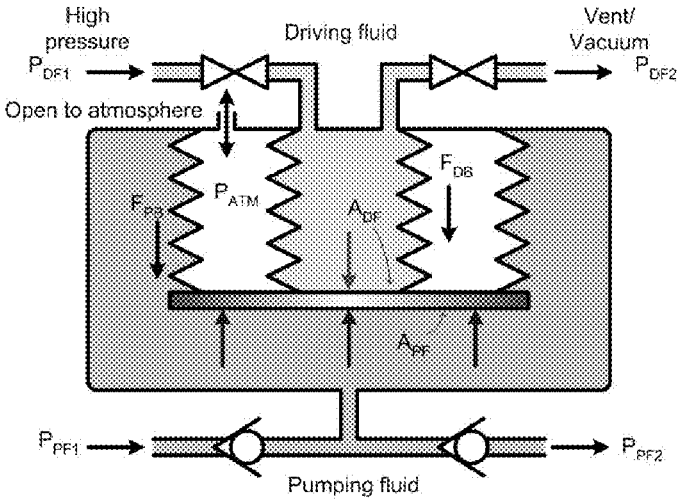
FIG. 6 is a schematic diagram of a pump assembly including a stroke volume multiplier with both the driving fluid bellows and the pumping fluid bellows concentrically disposed to assist in pressurizing and displacing the pumping fluid from the pumping fluid chamber.

FIG. 6 is a schematic diagram of a pump assembly including a stroke volume multiplier with both the driving fluid bellows and the pumping fluid bellows concentrically disposed to assist in pressurizing and displacing the pumping fluid from the pumping fluid chamber.

$$\text{Actuation Force at the limit of the pumping stroke} = P_{DF1} \times A_{DF} + P_{Atm}\left(\frac{A_{PF}}{A_{DF}} - \right) + F_{DB-exp} = P_{PF2} \times A_{PF} - F_{PB-exp}$$

$$\text{Actuation Pressure} = P_{DF1} = \frac{P_{PF2} \times A_{PF} - P_{Atm}\left(\frac{A_{PF}}{A_{DF}} - \right) - F_{PB-exp} - F_{DB-exp}}{A_{DF}}$$

$$\text{Retraction Force} = P_{DF2} \times A_{DF} + P_{Atm}(A_{PF} - A_{DF}) + F_{DB-comp} = P_{PF1} \times A_{PF} - F_{PB-comp}$$

$$\text{Retraction Pressure} = P_{DF2} = \frac{P_{PF1} \times A_{PF} - P_{Atm}\left(\frac{A_{PF}}{A_{DF}} - \right) - F_{PB-comp} - F_{DB-comp}}{A_{DF}}$$

$$\text{Moles of driving gas/pumping volume displaced} = \frac{N}{V_{PF}} \propto \frac{P_{DF1} \times V_{DF}}{V_{PF}} = \frac{P_{DF1} \times A_{DF}}{A_{PF}} = P_{PF2} - P_{Atm} + \frac{P_{Atm} A_{DF}}{A_{PF}} - \frac{F_{PB-exp} + F_{DB-exp}}{A_{PF}}$$

With concentric bellows, the bellows forces are acting in unison to allow the driving pressure to be further reduced, but this also requires the retraction vacuum pressure to be reduced. This in turn reduces the number of moles of driving gas required per stroke.

Figure 7:
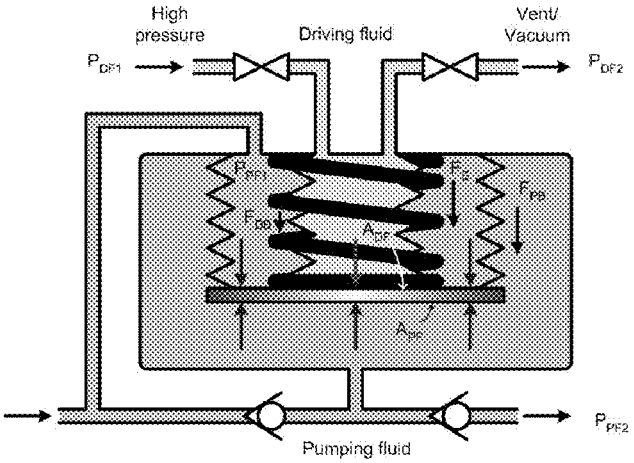
FIG. 7 is a schematic diagram of a pump assembly including a stroke volume multiplier with the driving fluid bellows, the pumping fluid bellows, a spring and the pressure of the pumping source each assisting in pressurizing and displacing the pumping fluid from the pumping fluid chamber.

FIG. 7 is a schematic diagram of a pump assembly including a stroke volume multiplier with the driving fluid bellows, the pumping fluid bellows, a spring and the pressure of the pumping source each assisting in pressurizing and displacing the pumping fluid from the pumping fluid chamber.

$$\text{Actuation Force at the limit of the pumping stroke} = P_{DF1} \times A_{DF} + P_{PF1}\left(\frac{A_{PF}}{A_{DF}} - \right) + F_{DB-exp} + F_S = P_{PF2} \times A_{PF} - F_{PB-exp}$$

-continued $$\text{Actuation Pressure} = P_{DF1} = \frac{P_{PF2} \times A_{PF} - P_{PF1}\left(A_{PF} - A_{DF}\right) - F_{PB-exp} - F_{DB-exp} - F_S}{A_{DF}}$$

$$\text{Retraction Force} = P_{DF2} \times A_{DF} + P_{PF1}(A_{PF} - A_{DF}) + F_{DB-comp} + F_S = P_{PF1} \times A_{PF} - F_{PB-comp}$$

$$\text{Retraction Pressure} = P_{DF2} = \frac{P_{PF1} \times A_{PF} - P_{PF1}\left(A_{PF} - A_{DF}\right) - F_{PB-comp} - F_{DB-comp} - F_S}{A_{DF}}$$

$$\text{Moles of driving gas/pumping volume displaced} = \frac{N}{V_{PF}} \propto \frac{P_{DF1} \times V_{DF}}{V_{PF}} = \frac{P_{DF1} \times A_{DF}}{A_{PF}} = \Delta P_{PF2} + \frac{P_{PF1} A_{DF}}{A_{PF}} - F_{PB-exp} + \frac{F_{DB-exp} + F_S}{A_{PF}}$$

Figure 8:
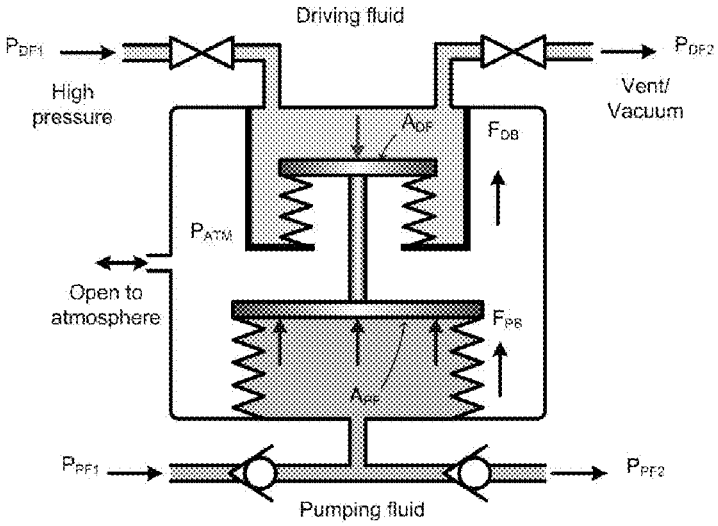
FIG. 8 is a schematic diagram of a pump assembly including driving fluid bellows and the pumping fluid bellows assisting in drawing the pumping fluid into the pump fluid chamber.

FIG. 8 is a schematic diagram of a pump assembly including a stroke volume multiplier with the atmospheric pressure assisting in pressurizing and displacing the pumping fluid from the pumping fluid chamber. The driving fluid bellows and the pumping fluid bellows are configured to assisting in drawing the pumping fluid into the pump fluid chamber, as might be required in a vacuum pump.

$$\text{Actuation Force at the limit of the pumping stroke} = P_{DF1} \times A_{DF} + P_{Atm}\left(A_{PF} - A_{DF}\right) - F_{DB-comp} = P_{PF2} \times A_{PF} + F_{PB-comp}$$

$$\text{Actuation Pressure} = P_{DF1} = \frac{P_{PF2} \times A_{PF} - P_{Atm}\left(A_{PF} - A_{DF}\right) + F_{PB-comp} + F_{DB-comp}}{A_{DF}}$$

$$\text{Retraction Force} = P_{DF2} \times A_{DF} + P_{Atm}(A_{PF} - A_{DF}) - F_{DB-exp} + F_S = P_{PF1} \times A_{PF} + F_{PB-exp}$$

$$\text{Retraction Pressure} = P_{DF2} = \frac{P_{PF1} \times A_{PF} - P_{Atm}\left(A_{PF} - A_{DF}\right) + F_{PB-exp} + F_{DB-exp}}{A_{DF}}$$

-continued $$\text{Moles of driving gas/pumping volume displaced} = \frac{N}{V_{PF}} \propto \frac{P_{DF1} \times V_{DF}}{V_{PF}} = \frac{P_{DF1} \times A_{DF}}{A_{PF}} = P_{PF2} - P_{Atm} + \frac{P_{Atm} A_{DF}}{A_{PF}} + \frac{F_{PB-comp} + F_{DB-comp}}{A_{PF}}$$

Figure 9:
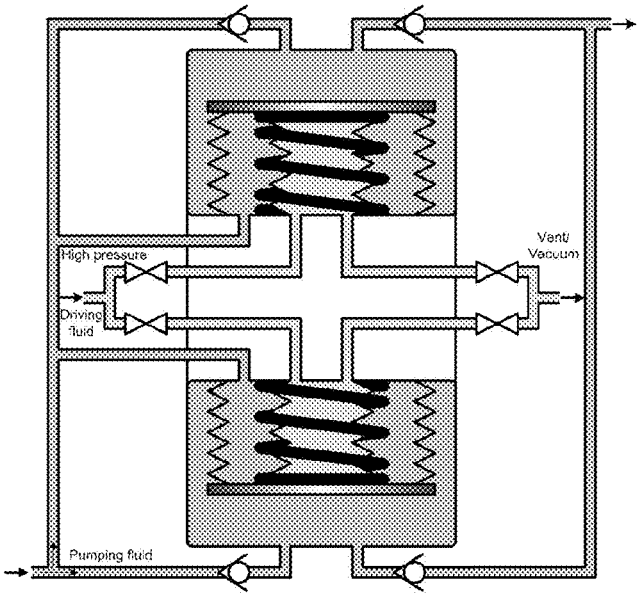
FIG. 9 is a schematic diagram of a pair of pump assemblies (each corresponding to FIG. 7) fluidically coupled to a common driving fluid actuator for alternating actuation and retraction of the driving fluid bellows with a stroke volume multiplier, wherein the driving fluid bellows, the pumping fluid bellows, a spring and the pressure of the pumping source each assisting in pressurizing and displacing the pumping fluid from the pumping fluid chamber.

FIG. 9 is a schematic diagram of a pair of pump assemblies (each corresponding to FIG. 7) fluidically coupled to a common driving fluid actuator for alternating actuation and retraction of the driving fluid bellows with a stroke volume multiplier, wherein the driving fluid bellows, the pumping fluid bellows, a spring and the pressure of the pumping source each assisting actuation of the driving fluid bellows. The forces required to operate the pump head have been described in relation to FIG. 7. It should be recognized that while the two pump heads in FIG. 9 are illustrated as being fluidically coupled with control valves, the use of an electrochemical actuator negates the need for the control valves and separate pressure and vent lines. Rather, an electrochemical stack may be disposed fluidically as in FIG. 3 or a single cell or multiple cells physically in parallel may be disposed fluidically as in FIG. 21.

Figure 10:
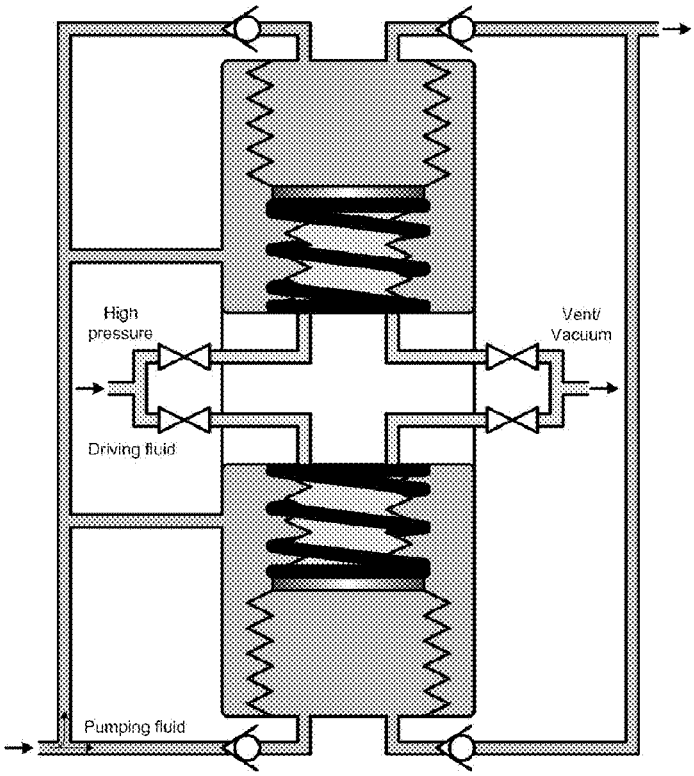
FIG. 10 is a schematic diagram of a pair of pump assemblies (each corresponding to FIG. 5D) fluidically coupled to a common driving fluid actuator for alternating actuation and retraction of the driving fluid bellows with a stroke volume multiplier and spring assistance.

FIG. 10 is a schematic diagram of a pair of pump assemblies (each corresponding to FIG. 5D) fluidically coupled to a common driving fluid actuator for alternating actuation and retraction of the driving fluid bellows with a stroke volume multiplier and spring assistance. As mention with respect to FIG. 9, an electrochemical actuator may be configured with the pump assemblies without use of the control valves and tubes.

Figure 11:
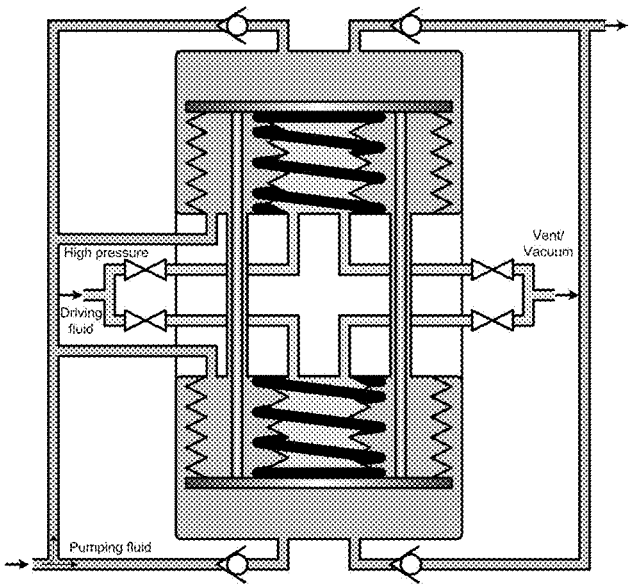
FIG. 11 is a schematic diagram of a pair of pump assemblies similar to FIG. 10, except that the spring assistance has been supplemented (or alternatively, replaced) with a mechanical coupling between the opposing stroke volume multipliers.

FIG. 11 is a schematic diagram of a pair of pump assemblies similar to FIG. 10, except that the spring assistance has been supplemented (or alternatively, replaced) with a mechanical coupling between the opposing stroke volume multipliers. Accordingly, the actuation of the two bellows pumps is mechanically linked. This arrangement may be referred to as a reciprocating dual bellows pump. Mechanically linking the actuation of a conventional dual bellows pump increases the pump efficiency. However, when used in conjunction with the stroke volume multiplier and spring, the pump is actually less efficient due to the cancelling forces of the springs.

Figure 12:
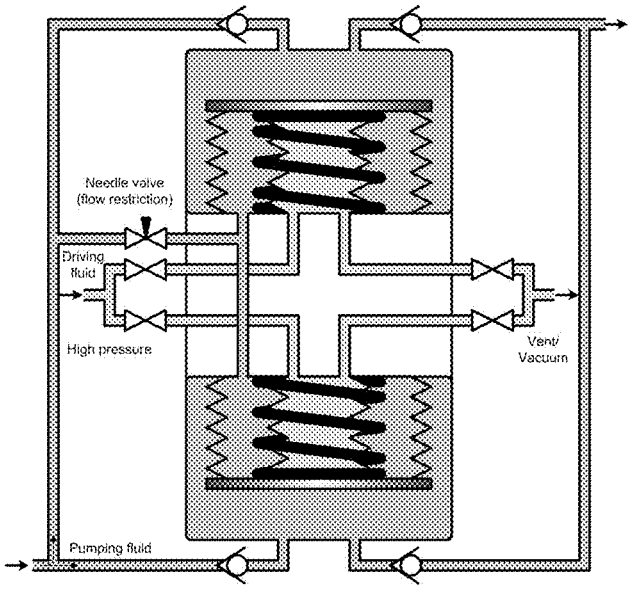
FIG. 12 is a schematic diagram of a pair of pump assemblies similar to FIG. 11, except that the mechanical coupled has been replaced with a flow restriction that affects a fluidic coupling between the opposing stroke volume multipliers.

FIG. 12 is a schematic diagram of a pair of pump assemblies similar to FIG. 11, except that the mechanical coupled has been replaced with a flow restriction that affects a fluidic coupling, rather than a mechanical coupling, between the opposing stroke volume multipliers.

Figure 13:
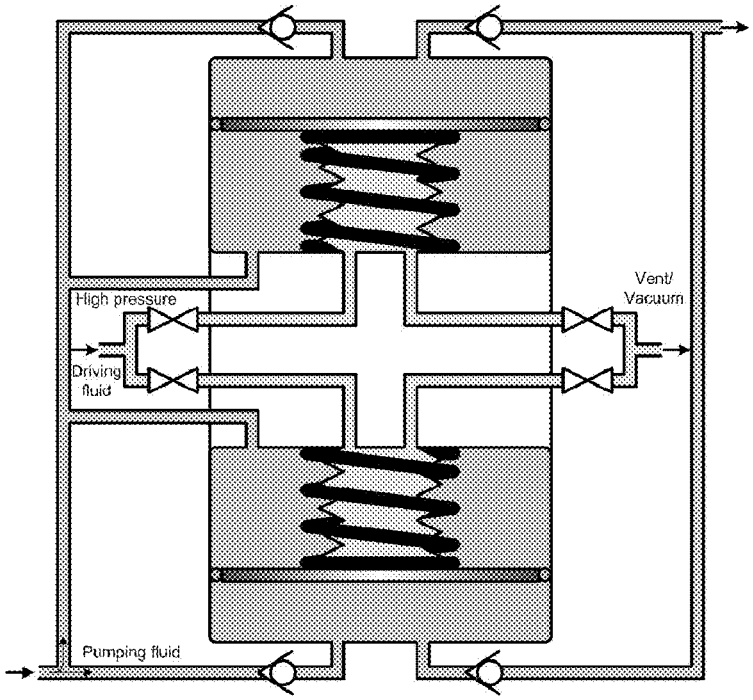
FIG. 13 is a schematic diagram of a pair of pump assemblies similar to FIG. 9, except that the pumping fluid bellows has been replaces with a piston.

FIG. 13 is a schematic diagram of a pair of pump assemblies similar to FIG. 9, except that the pumping fluid bellows has been replaces with a piston.

Figure 14:
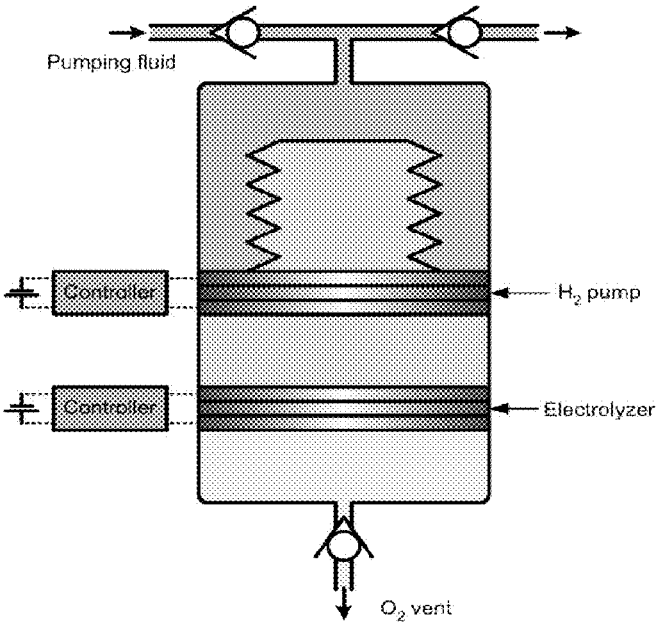
FIG. 14 is a schematic diagram of an electrochemical actuator in the form of an electrochemical hydrogen pump with one electrode in direct communication with a driving fluid bellows, and an electrolyzer for adjusting the amount of hydrogen gas available to the electrochemical hydrogen pump.

FIG. 14 is a schematic diagram of an electrochemical actuator in the form of an electrochemical hydrogen pump with one electrode in direct communication with a driving fluid bellows, and an electrolyzer for adjusting the amount of hydrogen gas available to the hydrogen pump. It should be recognized that a region below the electrochemical hydrogen pump may also be configured with a driving fluid bellows for use in conjunction with the pumps of FIGS.

9-13. The electrolyzer does not need to be the same size as the electrochemical hydrogen pump, and will typically be much smaller.

Due to its small molecular size, hydrogen permeates through most materials. Hermetically sealing the hydrogen within a device, such as an electrochemical actuator, for more than a few years is problematic. According to another embodiment of the invention, one solution is to create the hydrogen in the actuator when it is first needed and then replenish the hydrogen as it is lost. One method of hydrogen generation is via electrolysis of water to produce hydrogen and oxygen gas.

The amount of hydrogen in the electrochemical actuator can be determined by the time taken to drive all the hydrogen from one chamber to another. The voltage required to drive hydrogen from one chamber will be low until there is little hydrogen left to drive across the membrane electrode assemblies. When hydrogen is scarce, the voltage required to drive the same current will be much higher. If it is determined that the amount of hydrogen in the pump has diminished it can be replenished from the hydrogen source, such as an electrolyzer, that is in communication with one or multiple chambers of the pump.

Electrolysis can be performed in a separate electrolyzer or in one or more of the electrochemical cells of the electrochemical hydrogen pump. Water for electrolysis can be stored in the electrochemical membrane of the electrolyzer. Water stored in the electrochemical hydrogen pump can also be used for electrolysis since the water will diffuse between the membranes.

The oxygen gas generated by the electrolyzer must be removed to prevent it from recombining with the hydrogen gas. One option is to vent the gas through a check valve, as shown in FIG. 14, but this option is not ideal for long life pumps since the water contained in the electrochemical hydrogen pump and electrolyzer will eventually be lost. Since check valves do not seal perfectly, water vapor will escape through the check valve during storage. During operation, water vapor will be lost as the oxygen is purged.

Figure 15:
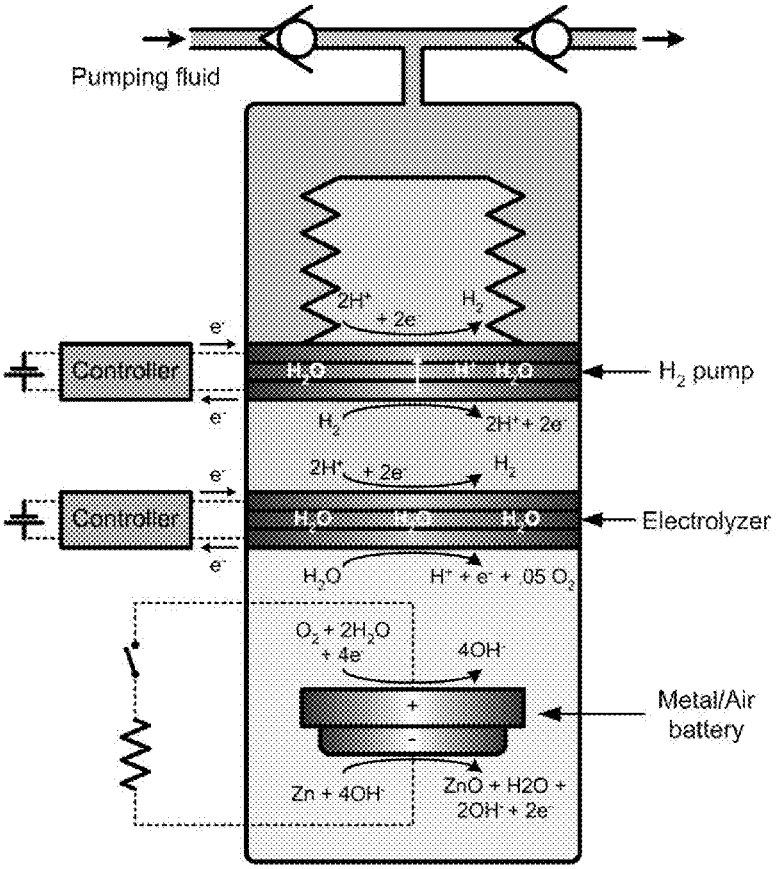
FIG. 15 is a schematic diagram of an electrochemical actuator in the form of an electrochemical hydrogen pump with one electrode in direct communication with a driving fluid bellows, an electrolyzer for adjusting the amount of hydrogen gas available to the electrochemical hydrogen pump, and a metal/air battery for consuming oxygen from the electrolyzer.

FIG. 15 is a schematic diagram of an electrochemical actuator in the form of an electrochemical hydrogen pump with one electrode in direct communication with a driving fluid bellows, an electrolyzer for adjusting the amount of hydrogen gas available to the electrochemical hydrogen pump, and a metal/air battery for consuming oxygen from the electrolyzer. A second method of removing the oxygen gas is to consume it in a metal/air battery, for example Zn/air, Li/Air, Fe/air etc, as shown in FIG. 15. By placing a load across the battery when oxygen gas is present, current will be drawn from the battery and the oxygen gas will be consumed.

Figure 16:
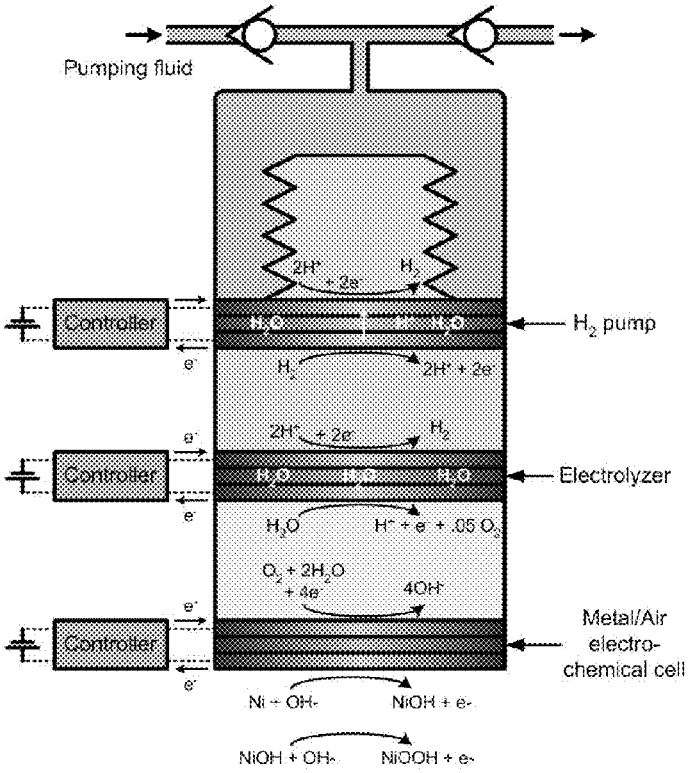
FIG. 16 is a schematic diagram of an electrochemical actuator in the form of an electrochemical hydrogen pump with one electrode in direct communication with a driving fluid bellows, an electrolyzer for adjusting the amount of hydrogen gas available to the electrochemical hydrogen pump, and a metal/air electrochemical cell for consuming oxygen from the electrolyzer.

FIG. 16 is a schematic diagram of an electrochemical actuator in the form of a electrochemical hydrogen pump with one electrode in direct communication with a driving fluid bellows, an electrolyzer for adjusting the amount of hydrogen gas available to the electrochemical hydrogen pump, and a metal/air electrochemical cell for consuming oxygen from the electrolyzer. A third method of removing the oxygen gas is to consume it in a metal/oxygen electrochemical cell, for example Ni/air, as shown in FIG. 16. This has the benefit that the total potential of the metal/air cell is too high for spontaneous hydrogen evolution. The nickel oxidation reaction is driven by applying a potential across the cell when oxygen gas is present. In some situations pump performance can be improved by reducing hydrogen pressure to an optimal level. This can be achieved by charging the metal/air battery or reversing the metal/oxygen electrochemical cell to generate oxygen gas. The oxygen will react with the hydrogen to form water.

According to another embodiment of the invention, any hydrogen lost is replenished with hydrogen stored within a metal hydride alloy material. The hydrogen can be extracted from the metal hydride through either gas phase or electrochemical means. This method also allows the hydrogen pressure within the device to be controllably increased or decreased by releasing or storing hydrogen within a metal hydride alloy.

Figure 17:
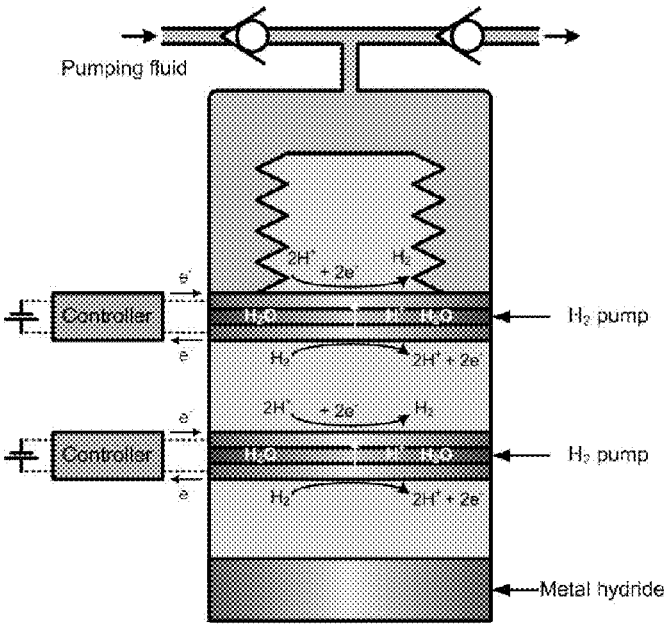
FIG. 17 is a schematic diagram of a pump assembly including metal hydride during operation to release hydrogen.

FIG. 17 is a schematic diagram of a pump assembly including metal hydride for the release of hydrogen. An electrochemical hydrogen pump can be used to move hydrogen gas from a chamber in which the metal hydride is stored and into the electrochemical actuator, thereby increasing the hydrogen pressure within the electrochemical actuator. The low hydrogen pressure created around the metal hydride alloy will result in the release of hydrogen from the metal hydride. The hydrogen pressure within the electrochemical actuator can be decreased by using an electrochemical hydrogen pump to move hydrogen from the actuator into a chamber in which the metal hydride alloy is stored. The increased hydrogen gas pressure about the hydride will result in hydrogen being absorbed by the metal hydride alloy.

Figure 18:
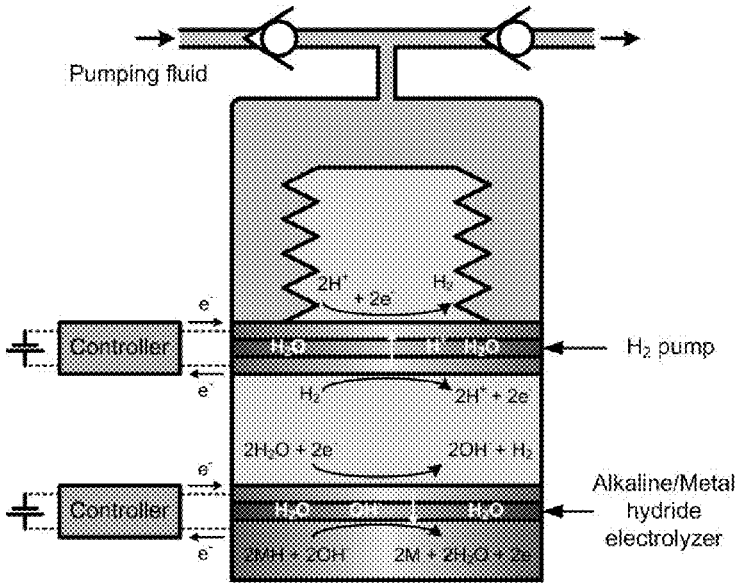
FIG. 18 is a schematic diagram of a pump assembly including an alkaline metal hydride electrolyzer during operation to release hydrogen.

FIG. 18 is a schematic diagram of a pump assembly including an alkaline metal hydride electrolyzer during operation to release hydrogen. Electrochemical release of hydrogen from the metal hydride can be achieved using the alkaline electrolyzer. Water is electrolyzed at the cathode to form hydrogen gas and OH ions. At the anode, the OH ions combine with hydrogen from the metal hydride to form water. This system has the benefit that it does not generate any oxygen so does not require the added complexity of an oxygen absorption system.

Figure 19:
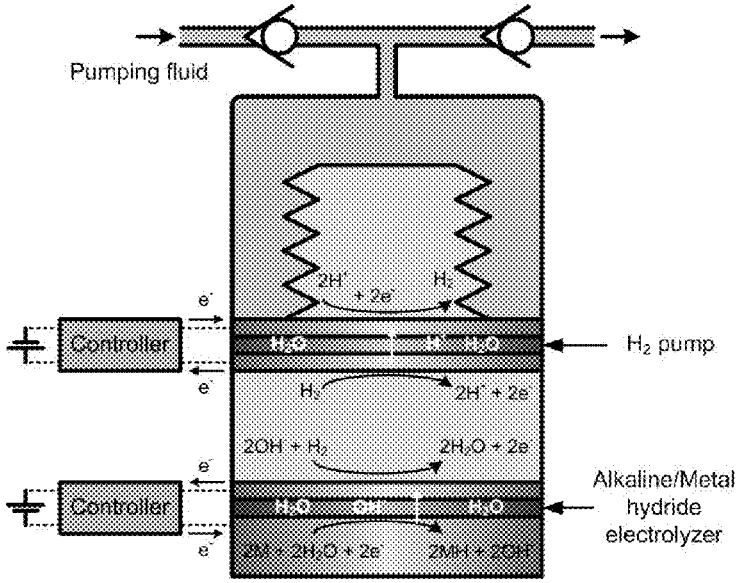
FIG. 19 is a schematic diagram of the pump assembly in FIG. 17 during operation to store hydrogen.

FIG. 19 is a schematic diagram of the pump assembly in FIG. 18 during operation to store hydrogen. Electrochemical storage of hydrogen is achieved by electrolyzing water at the metal hydride alloy which acts as a catalyst to form $OH^-$. The $H^+$ ions formed in the reaction attach to the metal hydride alloy. At the anode the OH ions combine with hydrogen gas to form water.

Figure 20A:
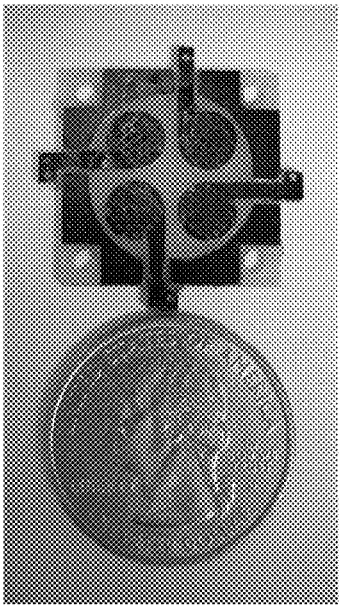
FIG. 20A is a plan view of a four cell current collector made from titanium with an applied protective coating.

FIG. 20A is a plan view of a four cell current collector. To prevent corrosion of the current collector, electrochemically stable materials such as graphite, gold, inconel, Ti—Ni alloys are used. Other materials which are not as stable, such as stainless steel, stainless steel, titanium, or niobium, can be used if protected by a conductive, electrochemically stable coating. The current collector shown is adhesively bonded to a fiberglass board and the electrode pattern machined out. This arrangement of multiple cells connected electronically in series is useful to address the very low power requirements of the electrochemical hydrogen pump. Since there are no commercially available DC/DC converters which can efficiently transform conventional battery voltages (1.2 to 3.0 V) down to the required pump voltage (<150 mV). A partial solution to this problem is the use of multiple pump cells connected electrically in series. The voltage that must be applied to the pump then becomes the sum of the voltage drop across each cell. This solution can become problematic if too great a number of cells are required. If a large number of cells are required, then the size of the individual cells can be too small making manufacturing and assembly difficult. However, this approach can be used to boost the driving voltage of the pump to a level where a DC/DC converter can operate more efficiently.

Figure 20B:
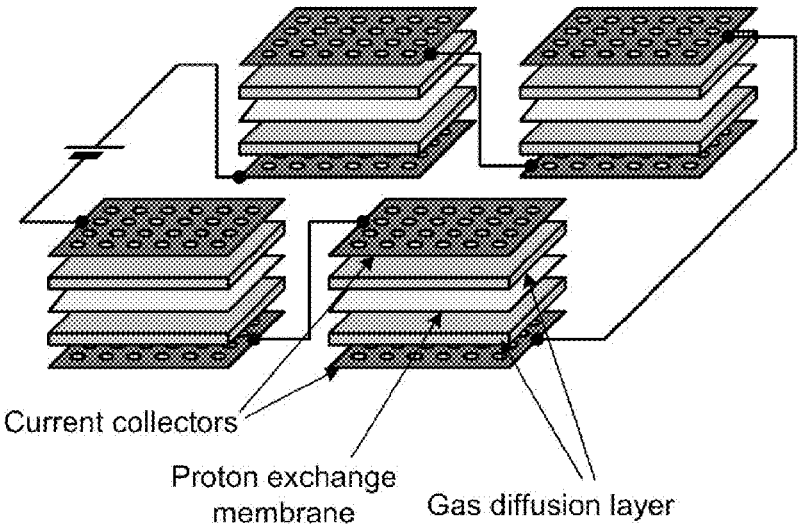
FIG. 20B is a schematic perspective view of the multiple cells of FIG. 21A.

FIG. 20B is a schematic perspective view of the multiple cells of FIG. 16A. With the multiple cells electrically connected in series, the voltage that must be applied to the pump is the sum of the voltages applied across each cell. The multiple electrochemical hydrogen pumps shown can share the same current collector support material, pump housing and proton conducting membrane.

Figure 21:
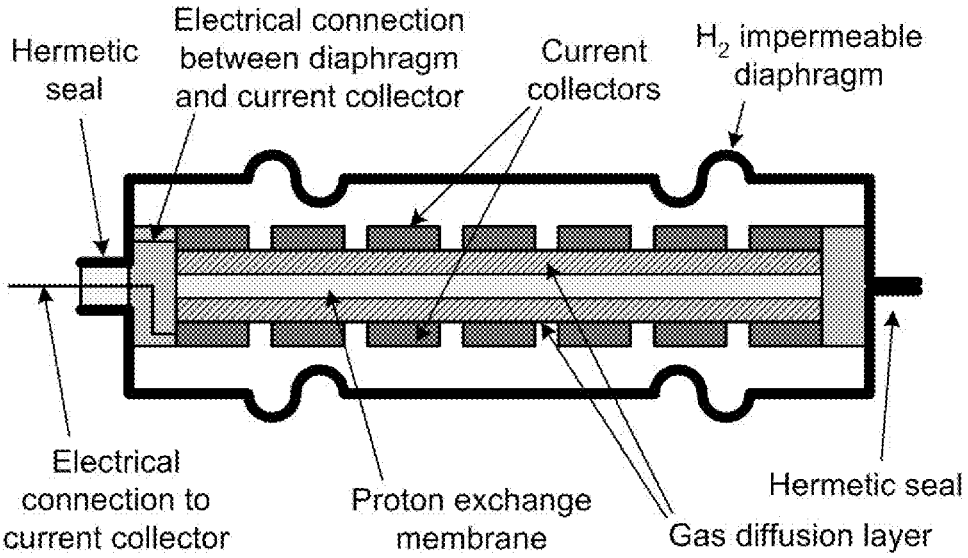
FIG. 21 is a schematic diagram of an electrochemical actuator that is hermetically sealed.

FIG. 21 is a schematic diagram of an electrochemical actuator that is hermetically sealed within a material, such as aluminum, that has a very low permeability to hydrogen. All components of the pump that come into contact with hydrogen, such as the current collectors, gas diffusion layers, and membranes, are within the hermetically sealed environment. Within this sealed environment, the rate of loss of hydrogen gas is extremely low and the humidity remains constant. The material used to hermetically seal the pump can also be used to form the diaphragm. Stretching or forming the material across the chambers of the pump can do this, for example. Two electrical connections must be made to the electrochemical actuator to drive the necessary ion current through the membrane electrode assembly. One of the electrical connections can be made directly through the sealing material if it is electrically conductive.

At very low pumping rates the multi-cell electrochemical hydrogen pumps still may not boost the driving voltage to a level where a conventional DC/DC converter circuits can operate efficiently unless a large number of cells are used, in which case manufacturing would be exceedingly difficult. One option is to take advantage of the fact that, unlike most electronic components, the electrochemical hydrogen pump does not need a "clean" or uniform voltage to operate. The flow rate is determined only by the average electrochemical hydrogen pump current. The only concern is if the root mean square (RMS) of the applied voltage is significantly greater than the average voltage, in which case the power drawn by the electrochemical hydrogen pump will be significantly greater than if the voltage were uniform. A conventional DC/DC converter can be used to efficiently convert a battery voltage down to 0.6 V (the lowest voltage that can efficiently be obtained with commercially available DC/DC converters), and then pulse width modulation (PWM) may be used to provide smaller average voltages to the electrochemical actuator. The duty cycle, that is the ratio of time the voltage is off to the time the voltage is on, determines the average value of the voltage across the electrochemical actuator.

Figure 22:
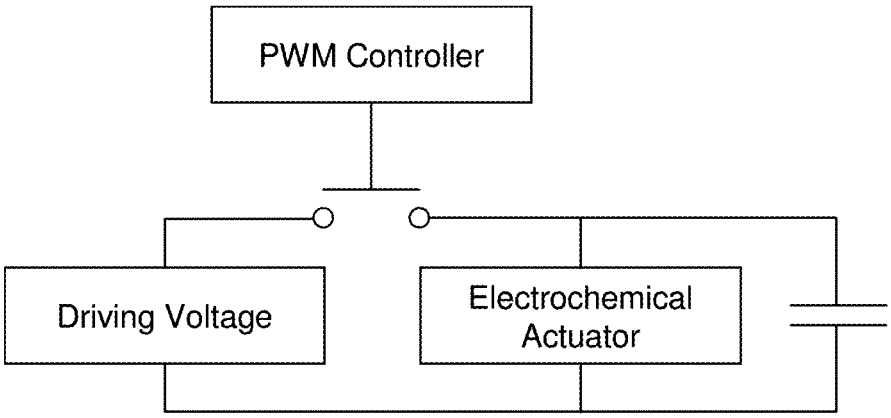
FIG. 22 is a block diagram of the pulse width modulation control of the electrochemical actuator voltage.

FIG. 22 is a block diagram of the PWM voltage control. The output of the DC/DC converter is fed to a low resistance electrical switch (such as a metal-oxide-semiconductor field-effect transistor or "MOSFET") that is controlled by a microcontroller. The microcontroller rapidly turns the MOSFET on and off, and so turns the voltage across electrochemical hydrogen pump on and off. The efficiency of the circuit depends only on the switch resistance and the RMS value of the voltage applied to the electrochemical hydrogen pump.

The efficiency of the PWM voltage control can be increased by placing a capacitor in parallel with the electrochemical hydrogen pump. This has the effect of reducing the RMS value of the applied voltage.

A 4-cell pump having 3 cm of active area may produce a load of about 1Ω. At a current of 100 mA, equivalent to a flow rate of 500 mL/hr, will consume only 30 mW. At currents below 50 mA, equivalent to a flow rate of 250 mL/hr, the efficiency starts to become poor, however, at these flow rates the power requirements of the pump are minimal.

In a still further embodiment of the invention, damage to the electrochemical hydrogen pump due to ice formation in the catalyst layer and GDL can be prevented by reducing the humidification in the electrochemical stack to less than 100% relative humidity. In the sealed environment of the stack, as the temperature of the stack is reduced, the water absorption capacity of the electrochemical membrane (typically Nafion) increases. This results in the relative humidity staying below 100% and prevents condensation of liquid water.

Still further, electrochemical cells are typically operated with a well humidified membrane in order to reduce the electrical loses. This poses a problem for electrochemical hydrogen pumps at high temperatures due the high water pressure in the sealed environment of the pump where the water vapor pressure can become a significant fraction of the hydrogen pressure. A large water vapor pressure will limit the compression of the driving fluid bellows and reduce the efficiency of the pump. By operating the pump with relatively dry membranes, the water vapor pressure is reduced (low relative humidity) and the reduction in pump stroke at high temperatures is minimized. When operating at high temperatures and low relative humidity, the membranes can dry out due to electro-osmotic drag, resulting in an increase in cell resistance. This effect can be reduced by incorporating hydroscopic metal oxide (e.g. $ZrO_2$, $TiO_2$, $SiO_2$, $WO_3$, and zeolite) particles in the membrane.

As will be appreciated by one skilled in the art, the controller used in various embodiments of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, the operation of the controller may take the form of a computer program product embodied in any tangible medium of expression having computer-usable program code embodied in the medium.

Any combination of one or more computer usable or computer readable medium(s) may be utilized. The computer-usable or computer-readable medium may be, for example but not limited to, an electronic, magnetic, optical, electromagnetic, infrared, or semiconductor system, apparatus, device, or propagation medium. More specific examples (a non-exhaustive list) of the computer-readable medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a transmission media such as those supporting the Internet or an intranet, or a magnetic storage device. Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory. In the context of this document, a computer-usable or computer-readable medium may be any medium that can contain, store, communicate, propagate, or transport the program for use by or in connection with the instruction execution system, apparatus, or device. The computer-usable medium may include a propagated data signal with the computer-usable program code embodied therewith, either in baseband or as part of a carrier wave. The computer usable program code may be transmitted using any appropriate medium, including but not limited to wireless, wireline, optical fiber cable, RF, etc.

Computer program code for carrying out operations of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the method.

These computer program instructions may also be stored in a computer-readable medium that can direct a computer or other programmable data processing apparatus to function in a particular manner, such that the instructions stored in the computer-readable medium produce an article of manufacture including instruction means which implement the function/act specified in the method.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide processes for implementing the functions/acts specified in the method discussed above.

It should be recognized that many, if not all, of the pump designs disclosed above, in the context of being driven by an electrochemical actuator, may also be driven by other means. For example, the pump designs may be driven by gases pressurized by mechanical means or driven by mechanical linkage to mechanical or electromechanical devices. One nonlimiting example is an electrical motor rotating a cam shaft that engages a cam follower having a distal end that reciprocates to expand and/or contract the bellows or a corresponding piston.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, components and/or groups, but do not preclude the presence or addition of one or more other features, integers, steps, operations, elements, components, and/or groups thereof. The terms "preferably," "preferred," "prefer," "optionally," "may," and similar terms are used to indicate that an item, condition or step being referred to is an optional (not required) feature of the invention.

The corresponding structures, materials, acts, and equivalents of all means or steps plus function elements in the claims below are intended to include any structure, material, or act for performing the function in combination with other claimed elements as specifically claimed. The description of the present invention has been presented for purposes of illustration and description, but it not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A pump head operable with a driving fluid, comprising:

a moveable element that separates a driving fluid chamber and a pumping fluid chamber, wherein an inlet check valve is disposed to allow unidirectional fluid communication of a pumping fluid into the pumping fluid chamber, and an outlet check valve is disposed to allow unidirectional fluid communication of the pumping fluid out of the pumping fluid chamber, wherein the moveable element is mechanically displaced by the driving fluid or the pumping fluid and is a piston comprising a first rigid plate and a second rigid plate coupled to the first rigid plate by a shaft, and the first and second rigid plates each have a surface area in a plane perpendicular to the axial direction, wherein the surface area of the first rigid plate in fluid communication with the driving fluid is less than the surface area of the second rigid plate in fluid communication with the pumping fluid; and first and second control valves in fluid communication with the driving fluid chamber and selectively operable to establish the driving fluid chamber in fluid communication with a driving fluid source or vacuum, wherein the driving fluid and the pumping fluid are not in fluid communication.

2. The pump head of claim 1, wherein the first rigid plate has a first side in fluid communication with the driving fluid in the driving pump chamber and a second side that is open to atmosphere, and wherein the second rigid plate has a first side that is open to atmosphere and a second side in fluid communication with the pumping fluid in the pumping fluid chamber.

3. The pump head of claim 2, wherein the driving fluid chamber includes a rigid outer wall and a first expandable bellows secured between the rigid outer wall and the second side of the first rigid plate, and the pumping fluid chamber includes a second expandable bellows secured between the second side of the second rigid plate and a second side of a pump housing.

4. The pump head of claim 3, wherein the driving fluid is in fluid communication into the driving fluid chamber around the outer surfaces of the first expandable bellows.

5. The pump head of claim 3, wherein the pumping fluid is in fluid communication into the pumping fluid chamber and into contact with the inner surfaces of the second expandable bellows.

6. The pump head of claim 3, wherein the first and second expandable bellows define an axial direction of expansion and retraction.

* * * * *